United States Patent [19]

Small

[11] Patent Number: 4,595,370

[45] Date of Patent: Jun. 17, 1986

[54] INTEGRAL VALVE AND CYLINDER ASSEMBLY FOR POWER STEERED MARINE DRIVE

[75] Inventor: Mark Small, Boca Raton, Fla.

[73] Assignee: Brunswick Corp., Skokie, Ill.

[21] Appl. No.: 770,705

[22] Filed: Aug. 27, 1985

Related U.S. Application Data

[63] Continuation of Ser. No. 567,256, Dec. 30, 1983, abandoned.

[51] Int. Cl.[4] ..... B63H 25/30

[52] U.S. Cl. ..... 440/53; 114/150; 440/61; 440/62

[58] Field of Search ..... 114/150, 144 R; 91/431, 91/466; 440/53, 55, 61, 62; 180/152; 244/226; 251/294; 137/625.69

[56] References Cited

U.S. PATENT DOCUMENTS

| | | | |
|---|---|---|---|
| 3,045,650 | 7/1962 | Ambrosini | 91/466 |
| 3,450,087 | 2/1968 | Kuether | 114/150 |
| 3,613,504 | 10/1971 | Krauss | 244/226 |
| 3,631,833 | 1/1972 | Shimanckas | 440/55 |
| 3,692,260 | 9/1972 | Glaze et al. | 244/266 |
| 3,700,080 | 10/1972 | Delorean | 251/294 |
| 3,768,376 | 10/1973 | Orme | 91/466 |
| 4,295,833 | 10/1981 | Borst | 114/150 |
| 4,424,672 | 1/1984 | Kalhorn | 180/152 |

*Primary Examiner*—Sherman D. Basinger
*Assistant Examiner*—Edwin L. Swinehart
*Attorney, Agent, or Firm*—Andrus, Sceales, Starke & Sawall

[57] ABSTRACT

An integral hydraulic valve and cylinder assembly for power steering a marine drive. The assembly is operatively connected between the propulsion unit and the steering wheel of a boat and includes a common valve body for housing both the cylinder and the valve. A valve spool located within a spool-receiving bore formed in the valve body is axially slidable therein in response to movement of the steering wheel between neutral and operational positions for selectively establishing fluid communication of an inlet port with outlet ports and work passages in the valve body leading to the cylinder. A core wire is connected to the steering arm of the propulsion unit and is axially slidable within an internal bore in the valve body. In response to valve spool movement, hydraulic assistance is properly directed to aid in steering the boat.

11 Claims, 2 Drawing Figures

42
28a
38
28
98
84
40
88
22
20
32
36
30
18
14
16
24
74
28b
10
26

28
28a
98
38
54
36
86
44
66
P
RES
64
88
94
84
80
30
32
74
62
48
72
32b
50
58
52
90
32a
60
92
96
68
70
46
55
34
12
82
24
78
56
84a
76
74

INTEGRAL VALVE AND CYLINDER ASSEMBLY FOR POWER STEERED MARINE DRIVE

This application is a continuation of application Ser. No. 06/567,256, filed Dec. 30, 1983, now abandoned.

BACKGROUND OF THE INVENTION

The present invention relates to an integral hydraulic valve and cylinder assembly for power steering marine drive applications. The invention is suitable for use with marine drives that are steered or turned to alter the course of a boat. Such marine drives may typically comprise an inboard/outboard stern drive or an outboard motor.

A power steering assembly for a marine drive employs a hydraulic assist to reduce steering loads to the operator. The steering arm of the marine drive is connected to the piston rod of a hydraulic cylinder, and the housing of the cylinder in turn is anchored to the boat. The steering wheel of the boat is connected through a steering cable to a movable valve that controls the direction and flow magnitude of the hydraulic fluid provided to the hydraulic cylinder. The operator of the boat thus needs only to exert enough effort to operate the valve and not that required to actually steer the boat.

Heretofore power steering systems for marine drives such as that shown in U.S. Pat. No. 3,450,087 have utilized separate valve and cylinder components. This has required hydraulic connections between the discreet components and mounting brackets for each of the components both of which result in considerable additional cost to the marine drive.

U.S. Pat. No. 3,631,833 shows a power steering mechanism for a marine drive in which the valve is located at the end of the cylinder. However, such a mechanism is rather complex and includes a steering cable that extends coaxially through the cylinder rod to operate the valve.

SUMMARY OF THE INVENTION

A marine drive includes a hydraulic system which is operatively connected between the drive propulsion unit and the steering input control. This hydraulic system provides power steering assistance for the propulsion unit.

In order to accomplish this, the subject hydraulic system includes an integral hydraulic valve and cylinder assembly having a common valve body for housing both the cylinder and the valve. A valve spool is axially movable within a spool-receiving bore formed in the valve body. The valve spool reacts to the input forces produced by movement of the steering input control to move between neutral and operational positions which selectively establish fluid communication between an input port, outlet ports and work passages in the valve body which lead to the cylinder.

A steering cable core wire is axially slidable within an internal bore in the valve body and directly steers the drive propulsion unit through a steering lever in response to movement of the steering input control. If the steering cable core wire encounters resistance to movement of the steering lever, a reaction force due to this resistance will move the valve spool to properly direct hydraulic fluid to assist in steering.

BRIEF DESCRIPTION OF THE DRAWINGS

The invention will be further explained with the aid of the following drawings in which.

DESCRIPTION OF THE PREFERRED EMBODIMENT

Figure 1:
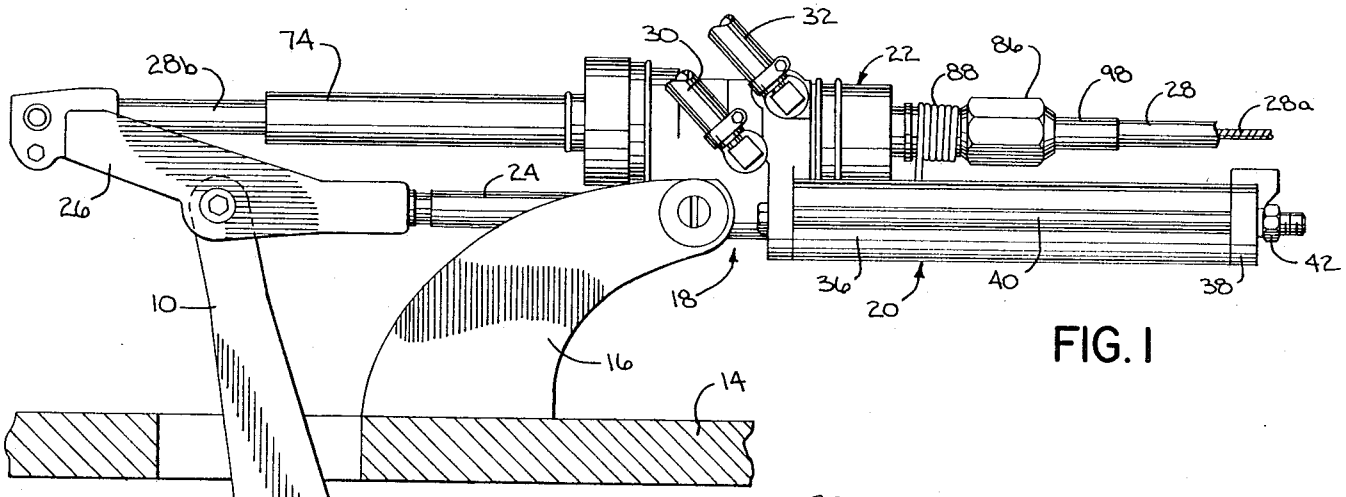
FIG. 1 is a top view of the improved integral hydraulic valve and cylinder assembly, along with the associated components of the marine drive and boat.

In FIG. 1, the numeral 10 indicates the steering arm of a marine drive, not shown. Steering arm 10 extends through transom 14 of the boat to pivot the marine drive about a pivot point 12. Bracket 16 mounts integral valve and cylinder assembly 18 on transom 14. Assembly 18 includes a hydraulic cylinder 20, and a hydraulic spool valve 22.

Piston rod 24 extends from cylinder 20 to bracket 26 pivotally mounted on steering arm 10. Valve 22 is operated by the outer housing jacket 28 of a steering cable connected to the helm of the boat. Core **28*a* of the cable extends through valve 22 and is connected at its end to rod 28*b* which in turn is connected to bracket 26. This permits operation of steering arm 10 without the assist from cylinder 20 in the event of a failure of the power steering system. Valve 22 is provided with hydraulic fluid through inlet line 30 and discharges hydraulic fluid through a pair of outlet passages 32*a* and 32*b* internally jointed to outlet line 32**.

Valve and cylinder assembly 18 incorporates a common valve body 34 which houses cylinder 20 and valve spool 68. Hydraulic cylinder 20 includes cylinder tube 36 having one end connected to common valve body 34. The other end of cylinder tube 36 is sealed by cap 38. Tie bolts and nuts, such as tie bolt 40 and nut 42 shown in FIG. 1 secure cap 38 to tube 36 and tube 36 to common valve body 34.

Piston 44 is slidably mounted within a piston-receiving bore 94 formed by cylinder tube 36. Piston rod 24 is fastened to piston 44 and extends through a rod-receiving bore 92 and seal 46 in body 34 to bracket 26. Common valve body 34 contains fluid passage 48 leading to one side of piston 44. The fluid passage leading to the other side of piston 44 includes passage 50 in common valve body 34, external fluid line 52, and fluid passage 54 in cap 38.

Valve body 34 contains annular inlet port 58 and a pair of annular outlet ports 60 and 62 which are spaced on either side of port 58 along a spoolreceiving bore 96 of body 34. Inlet line 30 is connected to inlet port 58. Outlet line 32 is connected to outlet ports 60 and 62 via internal passages **32*a* and 32*b* in valve body 34. Lines 30 and 32 are connected to a hydraulic system, of which only reservoir 64 and pump 66 is shown schematically in FIG. 2. Fluid passages 48 and 50 also open to the spoolreceiving bore 96 of valve body 34 as do the annular ports 58, 60, and 62**.

Valve spool 68 moves in the bore of valve body 34 substantially parallel to the movement of rod 24. Valve spool 68 contains spaced peripheral grooves 70 and 72 for selectively connecting the various ports and passages in valve body 34. Through axial movement of spool 68 in bore 96 of valve body 34, inlet port 58 is connected hydraulically to one of fluid passages 48 or 50. The other fluid passage 48 and 50 in turn is connected hydraulically to one of the discharge ports 60 or 62.

Tube 74 extends through spool 68, spool 68 abuts shoulder 76 on tube 74. Seal 78 is provided between an adjustment sleeve 56 and spool 68 adjacent shoulder 76. Nut 80 threaded on tube 74 secures spool 68 on tube 74. Spring 82 associated with seal 78 centrally positions spool 68 in body 34. Threaded adjustment sleeve 56 together with seal 55 allows positioning of spool 68 in relation to ports 58, 60, and 62 and ports 48 and 50 to effect balanced flow to either side of piston 44. Before steering input loads are applied, sleeve 56 and spring 82 position valve spool 68 in the neutral position in valve body 34. After steering input loads are applied and then relieved, spring 82 returns valve spool 68 to the neutral position. Cap 84 covers one end of valve body 34, spool 68, nut 80 and tube 74. Cap **84*a* covers the other end of valve body 34 and tube 74. Steering cable jacket 28 is connected to conduit 98 which in turn is secured to tube 74 by nut 86. Nut 86 is retained on tube 74 by spring wire retainer 88**.

Figure 2:
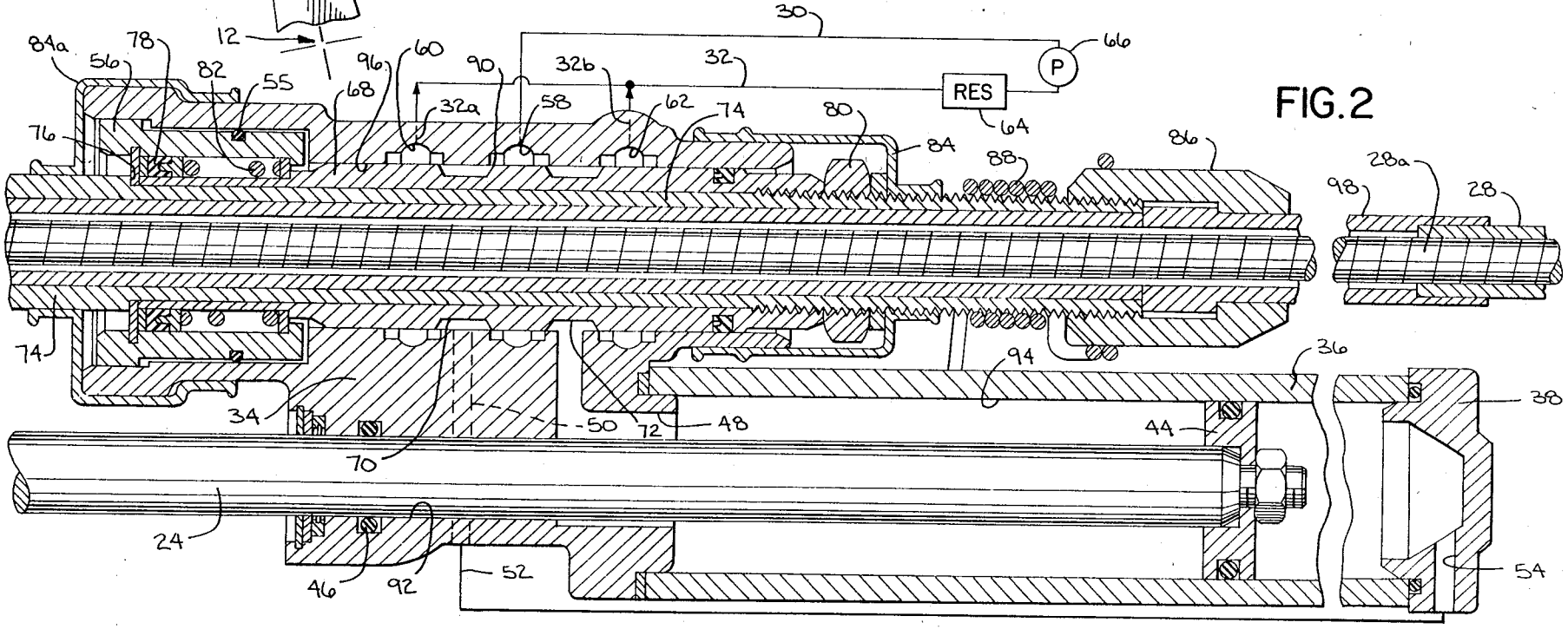
FIG. 2 is a cross sectional detailed view of the integral valve and cylinder of FIG. 1.

In operation, with valve spool 68 in the neutral position shown in FIG. 2, a small leakage flow or low pressure from inlet port 58 is provided to outlet ports 60 and 62 through clearances 90 shown in FIG. 2. The leakage flow or low pressure also appears in fluid passages 48 and 50 to selectively pressurize cylinder piston 44 on both sides and prevent movement of piston rod 24 and steering arm 10.

When steering cable core **28*a* moves, jacket 28 connected to valve spool 68 moves in the opposite direction in response to steering input. Inlet port 58 is progressively connected hydraulically to one of fluid passages 48 or 50. The other fluid passage is progressively connected hydraulically to one of the outlet ports 60 or 62. For example, if valve spool 68 is moved in the right hand direction of FIG. 2 by steering cable jacket 28, inlet port 58 is connected hydraulically to fluid passages 50 and 52, and fluid passage 48 is connected hydraulically to outlet port 62. The flow of fluid into passage 50 and out of passage 48 moves piston 44 and piston rod 24 in the leftward direction of FIG. 2 and pivots steering arm 10 about point 12** in the counterclockwise direction.

When steering cable jacket 28 moves valve spool 68 to the left, inlet port 58 is connected hydraulically to fluid passage 48 and fluid passages 50 and 52 are connected hydraulically to outlet port 60. The flow of fluid in passage 48 and out passage 52 moves piston 44 and piston rod 24 to the right and pivots steering arm 10 about point 12 in a clockwise direction.

The cable stroke is limited on the retracted end by the bracket 26 bottoming against the end of tube 74. The cable stroke is limited on the extended end of cable travel by a stop (not shown) in the steering wheel assembly.

Various modes of carrying out the invention are contemplated as being within the scope of the following claims particularly pointing out and distinctly claiming the subject matter which is regarded as the invention.

I claim:

1. An integral hydraulic valve and cylinder assembly for power steering a marine drive, comprising;

a valve body having a spool-receiving bore and a rodreceiving bore therein, said bores define longitudinal axes disposed parallel to and laterally spaced from one another, said spool-receiving bore communicating with a fluid inlet port, a pair of fluid outlet ports and a pair of work passages in said body, and said rod-receiving bore opening into a piston-receiving chamber disposed coaxially with said rod-receiving bore with one of said work passages in communication with one end of said chamber and the other of said work passages in communication with the other end of said chamber;

a valve spool axially slidable within said spoolreceiving bore between neutral and operational positions for selectively establishing fluid communication of the inlet port with the outlet ports and work passages;

a tubular member positioned coaxially within said spool and connected to said spool for movement therewith, said tubular member includes first and second ends projecting outwardly from opposite sides of said valve body and defines a cable-receiving bore therethrough for receiving a core of a steering cable having a cable jacket and core movable relative to one another, said core extendable therethrough for connection between a steering means and a steering arm of a marine drive;

connection means on one of the ends of said tubular member for connecting said tubular member with the cable jacket; and a rod axially slidable within said rod-receiving bore for assisting in moving said marine drive to alter the course of a boat, one end of said rod connectable to said marine drive and the other end of said rod connected to a piston slidable within said piston-receiving chamber.

2. The assembly of claim 1, wherein said outlet ports communicate with said spool-receiving bore at axially opposite sides of said inlet port.

3. The assembly of claim 2, wherein one of said work passages communicates with said spool-receiving bore at a location between one of said outlet ports and said inlet port and the other of said work passages communicates with said spool-receiving bore at a location between the other of said outlet ports and said inlet port.

4. A power steering assembly for a marine drive, the combination comprising a propulsion unit mounted for pivotal movement rearwardly of a boat, steering means operable from a point in the boat remote from said propulsion unit to pivot the propulsion unit to alter the course of a boat, and hydraulic means mounted on the boat and operatively connected to said propulsion unit and said steering means to provide power steering of said propulsion unit, said hydraulic means including a valve body having a spool-receiving bore and a rod-receiving bore therein, said bores define longitudinal axes disposed parallel to and laterally spaced from one another, said spool-receiving bore communicating with a fluid inlet port, a pair of fluid outlet ports and a pair of work passages in said body, and said rod-receiving bore opening into a piston-receiving chamber disposed coaxially with said rod-receiving bore with one of said work passages in communication with one end of said chamber and the other of said work passages in communication with the other end of said chamber, a valve spool axially slidable within said spool-receiving bore between neutral and operational positions for selectively establishing fluid communication of the inlet port with the outlet ports and work passages in response to movement of said steering means, a tubular member positioned coaxially within said spool and connected to said spool for movement therewith, said tubular member includes first and second ends projecting outwardly from opposite sides of said valve body and defines a cable-receiving bore therethrough, said steering means includes a steering cable having a cable jacket and core moveable relative to one another, said core connected at one end to said steering means and extending through said cable-receiving bore and connected at its other end to said propulsion unit, connection means on one of the ends of said tubular member for connecting said tubular member with said cable jacket, and a rod axially slidable within said rod-receiving bore for moving said marine drive to assist in altering the course of a boat, one end of said rod connected to said propulsion unit and the other end of said rod connected to a piston slidable within said piston-receiving chamber.

5. The assembly of claim 4, wherein said propulsion unit includes a steering arm mounted on said boat for pivotal movement about a substantially horizontal axis, and said one end of said rod is connected thereto to afford steering movement of said propulsion unit.

6. The assembly of claim 4, wherein said outlet ports communicate with said spool-receiving bore at axially opposite sides of said inlet port.

7. The assembly of claim 6, wherein one of said work passages communicates with said spool-receiving bore at a location between one of said outlet ports and said inlet port and the other of said work passages communicates with said spool-receiving bore at a location between the other of said outlet ports and said inlet port.

8. An integral hydraulic valve and cylinder assembly for power steering a marine drive, comprising;

a valve body having a spool-receiving bore and a rodreceiving bore therein, said bores define longitudinal axes disposed parallel to and laterally spaced from one another, said spool-receiving bore communicating with a fluid inlet port, a pair of fluid outlet ports and a pair of work passages in said body, and said rod-receiving bore opening into a piston-receiving chamber disposed coaxially with said rod-receiving bore with one of said work passages in communication with one end of said chamber and the other of said work passages in communication with the other end of said chamber;

a hollow valve spool axially slidable within said spool-receiving bore between neutral and operational positions for selectively establishing fluid communication of the inlet port with the outlet ports and work passages, said spool defines a longitudinal opening therethrough for receiving a steering cable having a cable jacket and core movable relative to one another, said core extendable through said longitudinal opening for connection between a steering means and a steering arm of a marine drive;

connection means for connecting said valve spool with the cable jacket for movement therewith; and a rod axially slidable within said rod-receiving bore for assisting in moving said marine drive to alter the course of a boat, one end of said rod connectable to said marine drive and the other end of said rod connected to a piston slidable within said piston-receiving chamber.

9. The assembly of claim 8, wherein said outlet ports communicate with said spool-receiving bore at axially opposite sides of said inlet port.

10. The assembly of claim 9, wherein one of said work passages communicates with said spool-receiving bore at a location between one of said outlet ports and said inlet port and the other of said work passages communicates with said spoolreceiving bore at a location between the other of said outlet ports and said inlet port.

11. The assembly of claim 8, wherein said connection means comprises a tubular member positioned coaxially within said spool and connected to said spool for movement therewith, said tubular member includes first and second ends projecting outwardly from opposite sides of said valve body and means on one of the ends of said tubular member for connecting said tubular member with the cable jacket.

* * * * *